US006685580B2

(12) United States Patent
Sullivan

(10) Patent No.: US 6,685,580 B2
(45) Date of Patent: Feb. 3, 2004

(54) THREE-LAYER COVER FOR A GOLF BALL INCLUDING A THIN DENSE LAYER

(75) Inventor: Michael J. Sullivan, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/163,714

(22) Filed: Jun. 5, 2002

(65) Prior Publication Data

US 2002/0151382 A1 Oct. 17, 2002

Related U.S. Application Data

(63) Continuation-in-part of application No. 10/163,545, filed on Jun. 6, 2002, and application No. 10/157,679, filed on May 29, 2002, and application No. 09/853,252, filed on Apr. 11, 2001, said application No. 10/163,545, is a continuation of application No. 10/082,577, filed on Feb. 25, 2002, which is a continuation-in-part of application No. 09/815,753, filed on Mar. 23, 2001, said application No. 10/157,679, is a continuation-in-part of application No. 09/842,574, filed on Apr. 26, 2001, which is a continuation-in-part of application No. 09/815,753.

(51) Int. Cl.[7] ..... A63B 37/04; A63B 37/06
(52) U.S. Cl. ..... 473/374; 473/371
(58) Field of Search ..... 473/351–378

(56) References Cited

U.S. PATENT DOCUMENTS

| | | | | |
|---|---|---|---|---|
| 4,431,193 A | | 2/1984 | Nesbitt | 273/235 |
| 4,625,964 A | | 12/1986 | Yamada | 273/62 |
| 4,863,167 A | | 9/1989 | Matsuki et al. | 273/62 |
| 5,002,281 A | | 3/1991 | Nakahara et al. | 273/220 |
| 5,048,838 A | | 9/1991 | Chikaraishi et al. | 273/228 |
| 5,104,126 A | | 4/1992 | Gentiluomo | 273/228 |
| 5,184,828 A | | 2/1993 | Kim et al. | 273/228 |
| 5,273,286 A | | 12/1993 | Sun | 273/228 |
| 5,482,285 A | | 1/1996 | Yabuki et al. | 273/228 |
| 5,688,191 A | | 11/1997 | Cavallaro et al. | 473/373 |
| 5,703,166 A | | 12/1997 | Rajagopalan et al. | 525/196 |
| 5,713,801 A | | 2/1998 | Aoyama | 473/354 |
| 5,733,428 A | * | 3/1998 | Calabria et al. | 264/134 |
| 5,759,676 A | | 6/1998 | Cavallaro et al. | 428/215 |
| 5,779,561 A | | 7/1998 | Sullivan et al. | 473/373 |
| 5,779,562 A | * | 7/1998 | Melvin et al. | 473/373 |
| 5,783,293 A | | 7/1998 | Lammi | 428/212 |
| 5,810,678 A | | 9/1998 | Cavallaro et al. | 473/373 |
| 5,813,923 A | | 9/1998 | Cavallaro et al. | 473/373 |
| 5,816,937 A | | 10/1998 | Shimosaka et al. | 473/354 |
| 5,823,889 A | | 10/1998 | Aoyama | 473/374 |
| 5,824,746 A | | 10/1998 | Harris et al. | 525/196 |
| 5,833,553 A | | 11/1998 | Sullivan et al. | 473/374 |

(List continued on next page.)

FOREIGN PATENT DOCUMENTS

| | | | |
|---|---|---|---|
| US | 2001/0016524 | 8/2001 | 473/378 |
| US | 2001/0019972 | 9/2001 | 473/372 |
| US | 2001/0024980 | 9/2001 | 473/372 |
| US | 2001/0024982 | 9/2001 | 473/377 |
| US | 2001/0031668 | 10/2001 | 473/351 |
| US | 2002/0034989 | 3/2002 | 473/373 |
| US | 2002/0045495 | 4/2002 | 473/370 |
| WO | WO 99/52604 | 10/1999 | |
| WO | WO 00/23519 | 4/2000 | |
| WO | WO 00/57962 | 10/2000 | |

OTHER PUBLICATIONS

Spalding Press Release Mar. 27, 2002.

*Primary Examiner*—Stephen Blau
*Assistant Examiner*—Alvin A. Hunter, Jr.

(57) ABSTRACT

A golf ball comprising a core and a cover, wherein the cover comprises an inner cover layer being disposed directly adjacent the core; an outer cover layer having a thickness less than about 0.050 inches; and an intermediate cover layer is disposed between the inner and outer cover layers; wherein at least one of the inner, intermediate, or outer cover layers is a dense layer having an inner diameter of at least 38.4 mm, a specific gravity greater than about 1.2 and a thickness between about 0.025 mm and about 1.27 mm.

25 Claims, 1 Drawing Sheet

U.S. PATENT DOCUMENTS 5,873,796 A 2/1999 Cavallaro et al. ..... 473/365
5,885,172 A 3/1999 Hebert et al. ..... 473/354
5,919,100 A 7/1999 Boehm et al. ..... 473/354
5,935,022 A 8/1999 Sugimoto et al. ..... 473/373
5,947,842 A 9/1999 Cavallaro et al. ..... 473/373
5,947,843 A 9/1999 Calabria et al. ..... 473/377
5,952,415 A 9/1999 Hwag ..... 524/399
5,965,669 A 10/1999 Cavallaro et al. ..... 525/221
5,967,908 A 10/1999 Yamagishi et al. ..... 473/373
5,981,658 A 11/1999 Rajagopalan et al. ..... 525/72
5,984,806 A 11/1999 Sullivan et al. ..... 473/373
5,989,136 A 11/1999 Renard et al. ..... 473/376
5,993,968 A 11/1999 Umezawa et al. ..... 428/407
6,010,411 A 1/2000 Reyes ..... 473/345
6,015,356 A 1/2000 Sullivan et al. ..... 473/373
6,025,442 A 2/2000 Harris et al. ..... 525/221
6,030,296 A 2/2000 Morgan et al. ..... 473/361
6,048,279 A 4/2000 Masutani ..... 473/372
6,057,403 A 5/2000 Sullivan et al. ..... 525/221
6,068,561 A 5/2000 Renard et al. ..... 473/364
6,071,201 A 6/2000 Maruko ..... 473/373
6,095,932 A 8/2000 Umezawa et al. ..... 473/356
6,102,815 A 8/2000 Sutherland ..... 473/372
6,117,025 A 9/2000 Sullivan ..... 473/373
6,120,392 A 9/2000 Kashiwagi et al. ..... 473/374
6,120,393 A 9/2000 Sullivan et al. ..... 473/377
6,124,389 A 9/2000 Cavallaro et al. ..... 524/432
6,126,558 A 10/2000 Higuchi et al. ..... 473/374
6,126,559 A 10/2000 Sullivan et al. ..... 473/378
6,129,640 A 10/2000 Higuchi et al. ..... 473/374
6,142,886 A 11/2000 Sullivan et al. ..... 473/371
6,142,887 A 11/2000 Sullivan et al. ..... 473/374
6,142,888 A 11/2000 Higuchi et al. ..... 473/374
6,149,535 A 11/2000 Bissonnette et al. ..... 473/354
6,149,536 A 11/2000 Sullivan et al. ..... 473/376
6,152,834 A 11/2000 Sullivan ..... 473/365
6,183,382 B1 2/2001 Kim et al. ..... 473/374
6,193,618 B1 2/2001 Sullivan et al. ..... 473/373
6,219,453 B1 4/2001 Goldberg ..... 382/229
6,220,972 B1 * 4/2001 Sullivan et al. ..... 473/374
6,267,692 B1 7/2001 Higuchi et al. ..... 473/365
6,267,694 B1 7/2001 Higuchi et al. ..... 473/374
6,277,034 B1 8/2001 Nesbitt et al. ..... 473/372
6,290,614 B1 * 9/2001 Kennedy et al. ..... 473/378
6,299,550 B1 * 10/2001 Molitor et al. ..... 473/354
6,309,312 B1 10/2001 Sullivan et al. ..... 473/375
6,309,314 B1 10/2001 Sullivan et al. ..... 473/378
6,394,914 B1 5/2002 Sullivan ..... 473/376
6,416,425 B1 * 7/2002 Maruko et al. ..... 473/376

* cited by examiner

THREE-LAYER COVER FOR A GOLF BALL INCLUDING A THIN DENSE LAYER

CROSS REFERENCE TO RELATED APPLICATIONS

This application is a continuation-in-part of U.S. application Ser. No. 09/853,252, filed Apr. 11, 2001. This application is also a continuation-in-part of U.S. application Ser. No. 10/157,679, filed May 29, 2002, which is a continuation-in-part of U.S. application Ser. No. 09/842,574, filed Apr. 26, 2001, which is a continuation-in-part of co-pending U.S. application Ser. No. 09/815,753, filed on Mar. 23, 2001. This application is also a continuation-in-part of co-pending U.S. application Ser. No. 10/163,545 filed Jun. 6, 2002, which is a continuation of U.S. application Ser. No. 10/082,577, filed Feb. 25, 2002, which is also a continuation-in-part of co-pending U.S. application Ser. No. 09/815,753, filed on Mar. 23, 2001. The disclosures of the parent applications are incorporated herein by reference in their entireties.

FIELD OF THE INVENTION

This invention relates generally to golf balls, and more specifically, to a golf ball having a cover comprising three or more layers.

BACKGROUND OF THE INVENTION

The majority of golf balls commercially available today can be grouped into two general classes: solid and wound. Solid golf balls include one-piece, two-piece, and multi-layer golf balls. One-piece golf balls are inexpensive and easy to construct, but have limited playing characteristics and their use is usually confined to the driving range. Two-piece balls are generally constructed with a polybutadiene solid core and a cover and are typically the most popular with recreational golfers because they are very durable and provide good distance. These balls are also relatively inexpensive and easy to manufacture, but are regarded by top players as having limited playing characteristics. Multi-layer golf balls are comprised of a solid core and a cover, either of which may be formed of one or more layers. These balls are regarded as having an extended range of playing characteristics, but are more expensive and difficult to manufacture than are one- and two-piece golf balls.

Wound golf balls, which typically include a fluid-filled center surrounded by tensioned elastomeric material and a cover, are preferred by many players due to their spin and "feel" characteristics but are more difficult and expensive to manufacture than are most solid golf balls. Manufacturers are constantly striving, therefore, to produce a solid ball that retains the beneficial characteristics of a solid ball while concurrently exhibiting the beneficial characteristics of a wound ball.

Golf ball playing characteristics, such as compression, velocity, "feel," and, therefore, spin, can be adjusted and optimized by manufacturers to suit players having a wide variety of playing abilities. For example, manufacturers can alter any or all of these properties by changing the materials (i.e., polymer compositions) and/or the physical construction of each or all of the various golf ball components (i.e., centers, cores, intermediate layers, and covers). Finding the right combination of core and layer materials and the ideal ball construction to produce a golf ball suited for a predetermined set of performance criteria is a challenging task.

Efforts to construct a multi-layer golf ball that has the benefits of both solid and wound balls have been numerous but manufacturers have generally focused on the use of cover layers formed of ionomeric compositions. It has been determined, however, that it is difficult to provide good "feel" characteristics in a golf ball with the use of non-polyurethane materials, such as ionomers, which tend to provide a "plastic feel."

It is desirable, therefore, to construct a golf ball formed of a thin urethane outer cover layer, at least two inner cover layers, and at least one core layer, according to the present invention. In particular, it is desired that this construction produce a multi-layer golf ball having variable spin rates, based on predetermined ball construction, while providing the golfer with good "feel" characteristics generally associated with other conventional ball constructions.

SUMMARY OF THE INVENTION

The present invention is directed to a golf ball comprising a core and a cover, wherein the cover includes an inner cover layer being disposed directly adjacent the core; an outer cover layer having a thickness less than about 0.050 inches; and an intermediate cover layer is disposed between the inner and outer cover layers; wherein at least one of the inner, intermediate, or outer cover layers is a dense layer having an inner diameter of at least 38.4 mm, a specific gravity greater than about 1.2 and a thickness between about 0.025 mm and about 1.27 mm.

The outer cover layer includes a composition formed of a reactive liquid material. The dense layer has a specific gravity of at least about 1.5, more preferably at least about 1.8, and most preferably at least about 2.0. The dense layer can include polyurethanes, polyureas, polyurethane ionomers, epoxies, polyesters, silicones, rubber latex, or a mixture thereof, or, alternatively, a thermoplastic polymer. The dense layer has a hardness of at least about 30 Shore D, more preferably at least about 50 Shore D, and most preferably at least about 60 Shore D.

The thermoplastic material for the dense layer includes polyolefins, polyethylene, polypropylene, polybutylene, polyethylene acrylic acid copolymers, polyethylene methacrylic acid copolymers, polyethylene methacrylic acid terpolymers, polyethylene acrylic acid terpolymers, polyethylene ethyl acrylate, polyethylene methyl acrylate, polyethylene vinyl acetate, polyethylene glycidyl alkyl acrylate, ionomers fully or partially neutralized by a metal ion or a salt of an organic acid, metallocenes, polyesters, polyamides, thermoplastic elastomers, copolyether-esters, copolyether-amides, thermoplastic polyurethanes, or a mixture thereof.

The thin dense layer is positioned at a distance ranging from 0.76 mm to 2.8 mm from the land surface of the ball and has a thickness of from 0.127 mm to 0.76 mm, preferably between about 0.25 mm and about 0.5 mm. The dense layer can include a densified loaded film or a thermoplastic polymer loaded with a specific gravity increasing agent, preferably tungsten powder. Alternatively, the dense layer is applied to the core as a liquid solution. preferably, the dense layer is formed by compression or injection molding, reaction injection molding, casting, spraying, dipping or powder coating.

The core is a non-wound core having a specific gravity of less than the specific gravity of the dense layer, a diameter between about 35 mm and about 42 mm, and a compression of less than about 90. In one embodiment, the inner cover is the dense layer and the intermediate and outer cover layers each have a specific gravity less than the dense layer. In an alternative embodiment, the intermediate layer is the dense layer and the inner and outer cover layers each have a specific gravity less than the dense layer.

The dense layer may also be a non-continuous layer and the core has a specific gravity of less than about 1.1. The non-continuous layer has a specific gravity greater than about 1.8, preferably greater than about 2.0. The golf ball may further include a second dense layer directly abutting the non-continuous layer.

DETAILED DESCRIPTION OF THE INVENTION

Figure 1:
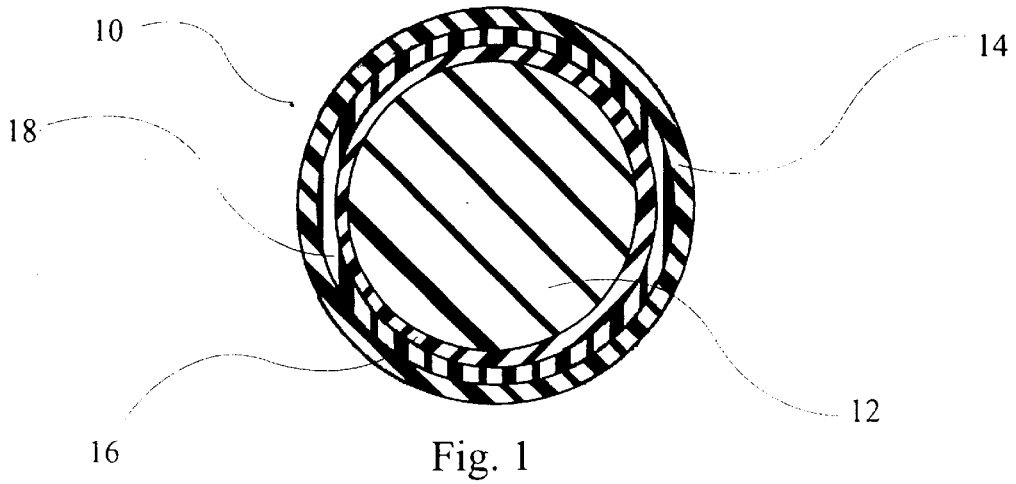
FIG. 1 is one embodiment of the golf ball of the present invention having a solid core and an inner, intermediate, and outer cover layer.
Figure 2:
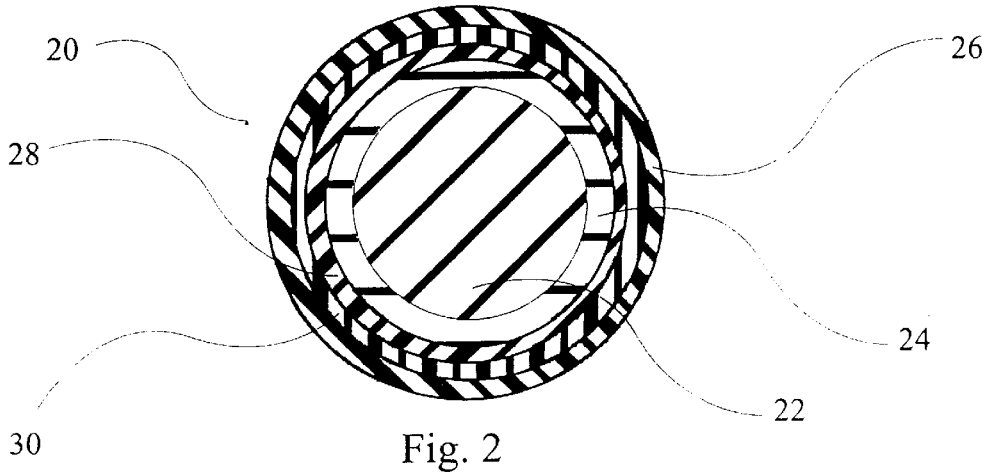
FIG. 2 is a second embodiment of the golf ball of the present invention having a core formed of a solid center and an outer core layer; and an inner, intermediate, and outer cover layer.
Figure 3:
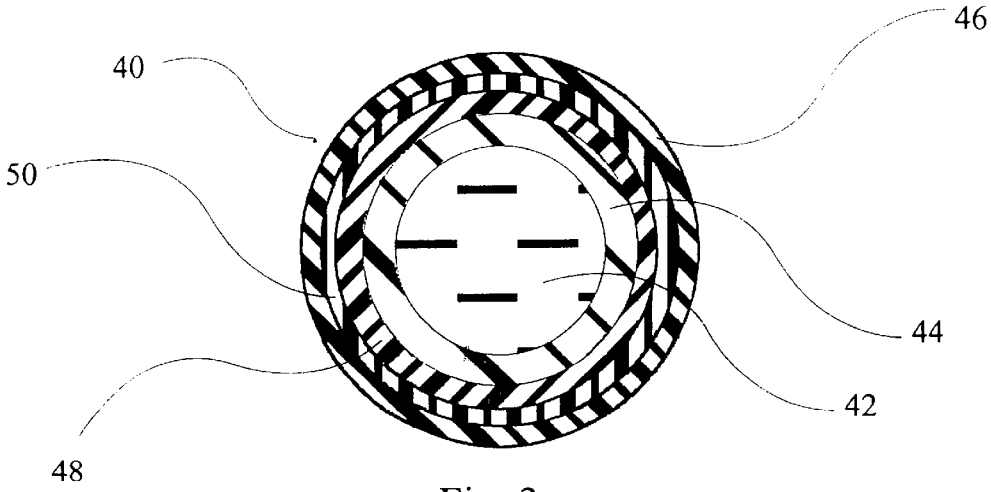
FIG. 3 is a third embodiment of the present invention having a liquid core formed of a liquid center and an outer core layer; and a cover formed of an inner, intermediate, and outer cover layer.

Referring to FIG. 1, a golf ball 10 of the present invention includes a core 12 and a cover comprising an outer cover 14 and at least two inner cover layers, such as inner cover layer 16 and intermediate cover layer 18. The golf ball cores of the present invention may be formed with a variety of constructions. For example, a golf ball 20 may also comprise a core comprising a plurality of layers, such as a center 22 and an outer core layer 24, and a cover comprising an outer cover layer 26, an inner cover layer 28, and an intermediate cover layer 30, as seen in FIG. 2. Referring to FIG. 3, the golf ball 40 may also comprise a core 44 comprising a solid, liquid, foam, gel, or hollow center 42, and a cover comprising an outer cover layer 46, an inner cover layer 48, and an intermediate cover layer 50. Any one of the inner cover layer 48 or the intermediate cover layer 50 may also comprise a tensioned elastomeric material. In a preferred embodiment, the core is a solid core.

Materials for solid cores include compositions having a base rubber, a filler, an initiator agent, and a crosslinking agent. The base rubber typically includes natural or synthetic rubber, such as polybutadiene rubber. A preferred base rubber is 1,4-polybutadiene having a cis-structure of at least 40%. Most preferably, however, the solid core is formed of a resilient rubber-based component comprising a high-Mooney-viscosity rubber and a crosslinking agent.

Another suitable rubber from which to form cores of the present invention is trans-polybutadiene. This polybutadiene isomer is formed by converting the cis-isomer of the polybutadiene to the trans-isomer during a molding cycle. Various combinations of polymers, cis-to-trans catalysts, fillers, crosslinkers, and a source of free radicals, may be used. A variety of methods and materials for performing the cis-to-trans conversion have been disclosed in U.S. Pat. No. 6,162,135 and U.S. application Ser. No. 09/461,736, filed Dec. 16, 1999; 09/458,676, filed Dec. 10, 1999; and 09/461,421, filed Dec. 16, 1999, each of which are incorporated herein, in their entirety, by reference.

Additionally, without wishing to be bound by any particular theory, it is believed that a low amount of 1,2-polybutadiene isomer ("vinyl-polybutadiene") is preferable in the initial polybutadiene to be converted to the trans-isomer. Typically, the vinyl polybutadiene isomer content is less than about 7 percent, more preferably less than about 4 percent, ans most preferably, less than about 2 percent.

Fillers added to one or more portions of the golf ball typically include processing aids or compounds to affect Theological and mixing properties, the specific gravity (i.e., density-modifying fillers), the modulus, the tear strength, reinforcement, and the like. The fillers are generally inorganic, and suitable fillers include numerous metals or metal oxides, such as zinc oxide and tin oxide, as well as barium sulfate, zinc sulfate, calcium carbonate, barium carbonate, clay, tungsten, tungsten carbide, an array of silicas, and mixtures thereof. Fillers may also include various foaming agents or blowing agents, zinc carbonate, regrind (recycled core material typically ground to about 30 mesh or less particle size), high-Mooney-viscosity rubber regrind, and the like. Polymeric, ceramic, metal, and glass microspheres may be solid or hollow, and filled or unfilled. Fillers are typically also added to one or more portions of the golf ball to modify the density thereof to conform to uniform golf ball standards. Fillers may also be used to modify the weight of the center or any or all core and cover layers, if present.

The initiator agent can be any known polymerization initiator which decomposes during the cure cycle. Suitable initiators include peroxide compounds such as dicumyl peroxide, 1,1-di(t-butylperoxy)3,3,5-trimethyl cyclohexane, a-a bis (t-butylperoxy)diisopropylbenzene, 2,5-dimethyl-2,5 di(t-butylperoxy)hexane or di-t-butyl peroxide and mixtures thereof.

Crosslinkers are included to increase the hardness and resilience of the reaction product. The crosslinking agent includes a metal salt of an unsaturated fatty acid such as a zinc salt or a magnesium salt of an unsaturated fatty acid having 3 to 8 carbon atoms such as acrylic or methacrylic acid. Suitable cross linking agents include metal salt diacrylates, dimethacrylates and monomethacrylates wherein the metal is magnesium, calcium, zinc, aluminum, sodium, lithium or nickel. Preferred acrylates include zinc acrylate, zinc diacrylate, zinc methacrylate, and zinc dimethacrylate, and mixtures thereof.

The crosslinking agent must be present in an amount sufficient to crosslink a portion of the chains of polymers in the resilient polymer component. This may be achieved, for example, by altering the type and amount of crosslinking agent, a method well-known to those of ordinary skill in the art.

When the core is formed of a single solid layer comprising a high-Mooney-viscosity rubber, the crosslinking agent is present in an amount from about 15 to about 40 parts per hundred, more preferably from about 30 to about 38 parts per hundred, and most preferably about 37 parts per hundred.

In another embodiment of the present invention, the core comprises a solid center and at least one outer core layer. When the optional outer core layer is present, the center preferably comprises a high-Mooney-viscosity rubber and a crosslinking agent present in an amount from about 10 to about 30 parts per hundred of the rubber, preferably from about 19 to about 25 parts per hundred of the rubber, and most preferably from about 20 to 24 parts crosslinking agent per hundred of rubber.

The core composition should comprise at least one rubber material having a resilience index of at least about 40. Preferably the resilience index is at least about 50. Polymers that produce resilient golf balls and, therefore, are suitable for the present invention, include but are not limited to CB23, CB22, BR60, and 1207G.

Additionally, the unvulcanized rubber, such as polybutadiene, in golf balls prepared according to the invention typically has a Mooney viscosity of between about 40 and about 80, more preferably, between about 45 and about 60, and most preferably, between about 45 and about 55. Mooney viscosity is typically measured according to ASTM D-1646.

The polymers, free-radical initiators, filler, crosslinking agents, and any other materials used in forming either the golf ball center or any portion of the core, in accordance with invention, may be combined to form a mixture by any type of mixing known to one of ordinary skill in the art. Suitable types of mixing include single pass and multi-pass mixing, and the like. The crosslinking agent, and any other optional additives used to modify the characteristics of the golf ball center or additional layer(s), may similarly be combined by any type of mixing. A single-pass mixing process where ingredients are added sequentially is preferred, as this type of mixing tends to increase efficiency and reduce costs for the process. The preferred mixing cycle is single step wherein the polymer, cis-to-trans catalyst, filler, zinc diacrylate, and peroxide are added sequentially.

Suitable mixing equipment is well known to those of ordinary skill in the art, and such equipment may include a Banbury mixer, a two-roll mill, or a twin screw extruder. Conventional mixing speeds for combining polymers are typically used, although the speed must be high enough to impart substantially uniform dispersion of the constituents. On the other hand, the speed should not be too high, as high mixing speeds tend to break down the polymers being mixed and particularly may undesirably decrease the molecular weight of the resilient polymer component. The speed should thus be low enough to avoid high shear, which may result in loss of desirably high molecular weight portions of the polymer component. Also, too high a mixing speed may undesirably result in creation of enough heat to initiate the crosslinking before the preforms are shaped and assembled around a core. The mixing temperature depends upon the type of polymer components, and more importantly, on the type of free-radical initiator. Additionally, it is important to maintain a mixing temperature below the peroxide decomposition temperature. Suitable mixing speeds and temperatures are well-known to those of ordinary skill in the art, or may be readily determined without undue experimentation.

The mixture can be subjected to compression or injection molding processes, for example, to obtain solid spheres for the core or hemispherical shells for forming an intermediate layer, such as an outer core layer or an inner cover layer. The polymer mixture is subjected to a molding cycle in which heat and pressure are applied while the mixture is confined within a mold. The cavity shape depends on the portion of the golf ball being formed. The molding cycle may have a single step of molding the mixture at a single temperature for a fixed time duration. The molding cycle may also include a two-step process, in which the polymer mixture is held in the mold at an initial temperature for an initial duration of time, followed by holding at a second, typically higher temperature for a second duration of time. In a preferred embodiment of the current invention, a single-step cure cycle is employed. Single-step processes are effective and efficient, reducing the time and cost of a two-step process.

Further, the core and layers of the present invention may be reaction injection molded ("RIM"), liquid injection molded ("LIM"), or injection molded. In the most preferred embodiment, the layers of the present invention are reaction injection molded. In the RIM process, at least two or more reactive low viscosity liquid components are mixed by impingement and injected under high pressure (1200 psi or higher) into an open or closed mold. The reaction times for the RIM systems are much faster than the low pressure mixing and metered machines and, consequently, the raw materials used for the RIM process are generally much lower in viscosity to allow intimate mixing. A RIM machine can process fast reacting materials having viscosities up to about 2,000 cP and a pot life of less than about 5 seconds. Because low viscosity materials are used in the RIM process, the components are capable of being mixed by impingement in less than a second before injecting the mixed material into the closed mold at about 2,000 to about 2,500 psi. With a conventional castable urethane process, materials having viscosities greater than about 3,500 are required and also require a pot life of greater than about 35 seconds.

The polybutadiene, cis-to-trans conversion catalyst, if present, additional polymers, free-radical initiator, filler, and any other materials used in forming any portion of the golf ball core, in accordance with the invention, may be combined to form a golf ball layer by an injection molding process, which is also well-known to one of ordinary skill in the art. Although the curing time depends on the various materials selected, those of ordinary skill in the art will be readily able to adjust the curing time upward or downward based on the particular materials used and the discussion herein.

The cover provides the interface between the ball and a club. Properties that are desirable for the cover include good moldability, high abrasion resistance, high tear strength, high resilience, and good mold release. The cover of the present invention is a multi-layer cover, preferably comprised of at least three layers, such as an inner cover layer, an intermediate cover layer, and an outer cover layer. While the various cover layers of the present invention may be of any individual thickness, it is preferred that the combination of cover layer thicknesses be no greater than about 0.125 inches, more preferably, no greater than about 0.105 inches, and most preferably, no greater than about 0.09 inches.

Any one of the at least three cover layers preferably has a thickness of less than about 0.05 inches, and more preferably, between about 0.02 inches and about 0.04 inches. Most preferably, the thickness of any one of the layers is between about 0.03 inches and about 0.04 inches.

The inner cover and any intermediate cover layers, can include any materials known to those of ordinary skill in the art, including thermoplastic and thermosetting materials, but preferably include ionic copolymers of ethylene and an unsaturated monocarboxylic acid, such as SURLYN®, commercially available from E. I. DuPont de Nemours & Co., of Wilmington, Del., and IOTEK® or ESCOR®, commercially available from Exxon. These are copolymers or terpolymers of ethylene and methacrylic acid or acrylic acid partially neutralized with salts of zinc, sodium, lithium, magnesium, potassium, calcium, manganese, nickel or the like, in which the salts are the reaction product of an olefin having from 2 to 8 carbon atoms and an unsaturated monocarboxylic acid having 3 to 8 carbon atoms. The carboxylic acid groups of the copolymer may be totally or partially neutralized and might include methacrylic, crotonic, maleic, fumaric or itaconic acid.

The cover materials of this invention can likewise be used in conjunction with homopolymeric and copolymer materials such as:

(1) Vinyl resins such as those formed by the polymerization of vinyl chloride, or by the copolymerization of vinyl chloride with vinyl acetate, acrylic esters or vinylidene chloride.

(2) Polyolefins such as polyethylene, polypropylene, polybutylene and copolymers such as ethylene methylacrylate, ethylene ethylacrylate, ethylene vinyl acetate, ethylene methacrylic or ethylene acrylic acid or propylene acrylic acid and copolymers and homopolymers produced using single-site catalyst.

(3) Polyurethanes including those prepared from polyols and diisocyanates or polyisocyanates and those disclosed in U.S. Pat. No. 5,334,673.

(4) Polyureas such as those disclosed in U.S. Pat. No. 5,484,870.

(5) Cationic and anionic polyurethane and polyurea ionomers, including:

(a) thermoplastic and thermoset cationic polyurethane and polyurea ionomers containing cationic moieties such as quaternized nitrogen groups associated with halide or acetate anion either on the pendant or polymer backbone of polyurethane or polyurea; or (b) thermoplastic and thermoset anionic polyurethane and polyurea ionomers containing anionic moieties such as carboxylate or sulfonate or phosphonate neutralized with counter cations either on the pendant or polymer backbone of polyurethane or polyurea.

(6) Non-elastic thermoplastics like polyesters and polyamides such as poly(hexamethylene adipamide) and others prepared from diamines and dibasic acids, as well as those from amino acids such as poly (caprolactam). Still further, non-elastic thermoplastics can include polyethylene terephthalate, polybutylene terephthalate, polyethylene terephthalate/glycol ("PETG"), polyphenylene oxide resins, and blends of non-elastic thermoplastics with SURLYN®, polyethylene, ethylene copolymers, ethylene-propylene diene terpolymer, etc.

(7) Acrylic resins and blends of these resins with poly vinyl chloride, elastomers, etc.

(8) Thermoplastic rubbers such as olefinic thermoplastic rubbers including blends of polyolefins with ethylene-propylene diene terpolymer.

(9) Thermoplastic elastomers including block copolymers of styrene and butadiene, or isoprene or ethylene-butylene rubber, copoly(ether-amides) such as PEBAX® sold by Elf-Atochem, copoly(ether-ester) block copolymer elastomers sold under the trademarks HYTREL® from DuPont and LOMOD® from General Electric Company of Pittsfield, Mass.

(10) Blends and alloys, including polycarbonate with acrylonitrile butadiene styrene, polybutylene terephthalate, polyethylene terephthalate, styrene maleic anhydride, polyethylene, elastomers, etc. Blends such as polyvinyl chloride with acrylonitrile butadiene styrene or ethylene vinyl acetate or other elastomers. Blends of thermoplastic rubbers with polyethylene, polypropylene, polyacetal, polyamides, polyesters, cellulose esters, etc.

(11) Saponified polymers and blends thereof, including: saponified polymers obtained by reacting copolymers or terpolymers having a first monomeric component having olefinic monomer from 2 to 8 carbon atoms, a second monomeric component comprising an unsaturated carboxylic acid based acrylate class ester having from 4 to 22 carbon atoms, and an optional third monomeric component comprising at least one monomer selected from the group consisting of carbon monoxide, sulfur dioxide, an anhydride, a glycidyl group and a vinyl ester with sufficient amount of an inorganic metal base. These saponified polymers can be blended with ionic and non-ionic thermoplastic and thermoplastic elastomeric materials to obtain a desirable property.

(12) Copolymer and terpolymers containing glycidyl alkyl acrylate and maleic anhydride groups, including: copolymers and terpolymers containing glycidyl alkyl acrylate and maleic anhydride groups with a first monomeric component having olefinic monomer from 2 to 8 carbon atoms, a second monomeric component comprising an unsaturated carboxylic acid based acrylate class ester having from 4 to 22 carbon atoms, and an optional third monomeric component comprising at least one monomer selected from the group consisting of carbon monoxide, sulfur dioxide, an anhydride, a glycidyl group and a vinyl ester. The above polymers can be blended with ionic and non-ionic thermoplastic and thermoplastic elastomeric materials to obtain a desirable mechanical property.

(13) HiCrystalline acid copolymers and their ionomers, including: acid copolymers or its ionomer derivatives formed from an ethylene and carboxylic acid copolymer comprising about 5 to 35 percent by weight acrylic or methacrylic acid, wherein said copolymer is polymerized at a temperature of about 130° C. to about 200° C. and a pressure of about 20,000 psi to about 50,000 psi and wherein up to about 70 percent to of the acid groups were neutralized with a metal ion.

(14) Oxa acid compounds including those containing oxa moiety in the backbone having the formula:

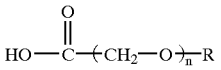

where R is an organic moiety comprising moieties having the formula:

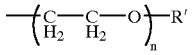

and alkyl, carbocyclic and heterocyclic groups; R' is an organic moiety comprising alkyl, carbocyclic, carboxylic acid, and heterocyclic groups; and n is an integer greater than 1. Also, R' can have the formula:

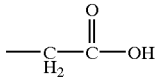

(15) Fluoropolymers including those having the following formula:

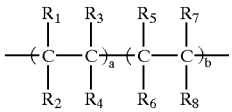

in which a is a number from 1 to 100, b is a number from 99 to 1, $R_1$–$R_7$ are independently selected from the group consisting of H, F, alkyl and aryl, and $R_8$ is F or a moiety of the formula:

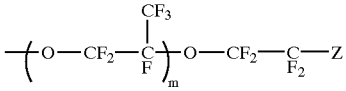

in which m is a number from 1 to 18 and Z is selected from the group consisting of $SO_2F$, cation selected from Group I, Ia, Ia, IIb, IIIa, IIIb, IVa, IVb and transition elements.

(16) Magnesium ionomers formed from an olefin and carboxyllic acid copolymer comprising about 5 to 35 weight percent of acrylic or methacrylic acid which are neutralized up to 60 weight percent by magnesium oxide or magnesium acetate or magnesium hydroxide.

Preferably, the inner and/or intermediate cover layer(s) are comprised of polymers such as ethylene, propylene, butene-1 or hexane-1 based homopolymers and copolymers including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethylene vinyl alcohol), poly(tetrafluoroethylene) and their copolymers including functional comonomers and blends thereof. Still further, the cover 11 is preferably comprised of a polyether or polyester thermoplastic urethane, a thermoset polyurethane, an ionomer such as acid-containing ethylene copolymer ionomers, including E/X/Y copolymers where E is ethylene, X is an acrylate or methacrylate-based softening comonomer present in 0 to 50 weight percent and Y is acrylic or methacrylic acid present in 5 to 35 weight percent. The acrylic or methacrylic acid is present in 16 to 35 weight percent, making the ionomer a high modulus ionomer, in 10 to 12 weight percent, making the ionomer a low modulus ionomer or in 13 to 15 weight percent, making the ionomer a standard ionomer. Generally, high acid ionomers provide a harder, more resilient ionomer. Covers made using high acid ionomers usually provide a high initial velocity and a low spin rate. on the other hand, covers made with a low modulus ionomer are generally softer and provide greater spin and control.

Preferably, the inner cover and intermediate cover layers include polymers, such as ethylene, propylene, butene-1 or hexane-1 based homopolymers or copolymers including functional monomers, such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethelyne vinyl alcohol), poly(tetrafluoroethylene) and their copolymers including functional comonomers, and blends thereof.

Suitable inner and intermediate cover layer compositions also include a polyether or polyester thermoplastic urethane, a thermoset polyurethane, a low modulus ionomer, such as acid-containing ethylene copolymer ionomers, including E/X/Y terpolymers where E is ethylene, X is an acrylate or methacrylate-based softening comonomer present in about 0 to 50 weight percent and Y is acrylic or methacrylic acid present in about 5 to 35 weight percent. More preferably, in a low spin rate embodiment designed for maximum distance, the acrylic or methacrylic acid is present in about 16 to 35 weight percent, making the ionomer a high modulus ionomer. In a higher spin embodiment, the inner cover layer includes an ionomer where an acid is present in about 10 to 15 weight percent and includes a softening comonomer.

Any cover layer, but preferably the outer cover layer, may include a polyurethane composition comprising the reaction product of at least one polyisocyanate, polyol, and at least one curing agent. Any polyisocyanate available to one of ordinary skill in the art is suitable for use according to the invention. Exemplary polyisocyanates include, but are not limited to, 4,4'-diphenylmethane diisocyanate ("MDI"); polymeric MDI; carbodiimide-modified liquid MDI; 4,4'-dicyclohexylmethane diisocyanate ("$H_{12}$MDI"); p-phenylene diisocyanate ("PPDI"); toluene diisocyanate ("TDI"); 3,3'-dimethyl-4,4'-biphenylene diisocyanate ("TODI"); isophoronediisocyanate ("IPDI"); hexamethylene diisocyanate ("HDI"); naphthalene diisocyanate ("NDI"); xylene diisocyanate ("XDI"); p-tetramethylxylene diisocyanate ("p-TMXDI"); m-tetramethylxylene diisocyanate ("m-TMXDI"); ethylene diisocyanate; propylene-1,2-diisocyanate; tetramethylene-1,4-diisocyanate; cyclohexyl diisocyanate;1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate ("TMDI"); tetracene diisocyanate; napthalene diisocyanate; anthracene diisocyanate; and mixtures thereof.

Preferably, the polyisocyanate includes MDI, PPDI, TDI, or a mixture thereof, and more preferably, the polyisocyanate includes MDI. It should be understood that, as used herein, the term "MDI" includes 4,4'-diphenylmethane diisocyanate, polymeric MDI, carbodiimide-modified liquid MDI, and mixtures thereof and, additionally, that the diisocyanate employed may be "low free monomer," understood by one of ordinary skill in the art to have lower levels of "free" monomer isocyanate groups, typically less than about 0.1% free monomer groups. Examples of "low free monomer" diisocyanates include, but are not limited to Low Free Monomer MDI, Low Free Monomer TDI, and Low Free Monomer PPDI.

The at least one polyisocyanate should have less than about 14% unreacted NCO groups. Preferably, the at least one polyisocyanate has no greater than about 7.5% NCO, and more preferably, less than about 7.0%.

Any polyol available to one of ordinary skill in the art is suitable for use according to the invention. Exemplary polyols include, but are not limited to, polyether polyols, hydroxy-terminated polybutadiene (including partially/fully hydrogenated derivatives), polyester polyols, polycaprolactone polyols, and polycarbonate polyols. In one preferred embodiment, the polyol includes polyether polyol. Examples include, but are not limited to, polytetramethylene ether glycol ("PTMEG"), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material of the invention. Suitable polyester polyols include, but are not limited to, polyethylene adipate glycol, polybutylene adipate glycol, polyethylene propylene adipate glycol, o-phthalate-1,6-hexanediol, and mixtures thereof. The hydrocarbon chain can have saturated or unsaturated bonds, or substituted or unsubstituted aromatic and cyclic groups.

In another embodiment, polycaprolactone polyols are included in the materials of the invention. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

In yet another embodiment, the polycarbonate polyols are included in the polyurethane material of the invention. Suitable polycarbonates include, but are not limited to, polyphthalate carbonate. The hydrocarbon chain can have saturated or unsaturated bonds, or substituted or unsubstituted aromatic and cyclic groups. In one embodiment, the molecular weight of the polyol is from about 200 to about 4000.

Polyamine curatives are also suitable for use in the polyurethane composition of the invention and have been found to improve cut, shear, and impact resistance of the resultant balls. Preferred polyamine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline ("MDA"); m-phenylenediamine ("MPDA"); 4,4'-methylene-bis-(2-chloroaniline) ("MOCA"); 4,4'-methylene-bis-(2,6-diethylaniline); 4,4'-diamino-3,3'-diethyl-5,5'-dimethyl diphenylmethane; 2,2', 3,3'-tetrachloro diamino diphenylmethane; 4,4'-methylene-bis-(3-chloro-2,6-diethylaniline); trimethylene glycol di-p-aminobenzoate; and mixtures thereof. Preferably, the curing agent of the present invention includes 3,5-dimethylthio-2,4-toluenediamine and isomers thereof, such as ETHACURE 300, commercially available from Albermarle Corporation of Baton Rouge, La. Suitable polyamine curatives, which include both primary and secondary amines, preferably have molecular weights ranging from about 64 to about 2000.

At least one of a diol, triol, tetraol, or hydroxy-terminated curatives may be added to the aforementioned polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy)benzene; 1,3-bis-[2-(2-hydroxyethoxy) ethoxy]benzene; 1,3-bis-{2-[2-(2-hydroxyethoxy)ethoxy] ethoxy}benzene; 1,4-butanediol; 1,5-pentanediol; 1,6-hexanediol; resorcinol-di-(β-hydroxyethyl)ether; hydroquinone-di-(β-hydroxyethyl)ether; and mixtures thereof. Preferred hydroxy-terminated curatives include ethylene glycol; diethylene glycol; 1,4-butanediol; 1,5-pentanediol; 1,6-hexanediol, trimethylol propane, and mixtures thereof. Preferably, the hydroxy-terminated curatives have molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

It should also be understood that slow-reacting amine curatives, such as VERSALINK® P-250, VERSALINK® P-650, and POLAMINE®, and fast-reacting curatives, such as ETHACURE® 100 and ETHACURE® 300, may be used individually or as mixtures. Further, blending of these curatives, and/or varying the mixing temperature and speed, for example, can adjust the cure rate as desired. Light stable polyurethanes, such as those disclosed in U.S. application Ser. No. 09/812,910, filed Mar. 20, 2001, are also suitable for the layers of the present invention and are incorporated herein by express reference thereto.

Any method known to one of ordinary skill in the art may be used to combine the polyisocyanate, polyol, and curing agent of the present invention. One commonly employed method, known in the art as a one-shot method, involves concurrent mixing of the polyisocyanate, polyol, and curing agent. This method results in a mixture that is inhomogenous (more random) and affords the manufacturer less control over the molecular structure of the resultant composition. A preferred method of mixing is known as a prepolymer method. In this method, the polyisocyanate and the polyol are mixed separately prior to addition of the curing agent. This method affords a more homogeneous mixture resulting in a more consistent polymer composition.

An optional filler component may be chosen to impart additional density to blends of the previously described components. The selection of such filler(s) is dependent upon the type of golf ball desired (i.e., one-piece, two-piece multi-component, or wound). Examples of useful fillers include zinc oxide, barium sulfate, calcium oxide, calcium carbonate and silica, as well as the other well known corresponding salts and oxides thereof. Additives, such as nanoparticles, glass spheres, and various metals, such as titanium and tungsten, can be added to the polyurethane compositions of the present invention, in amounts as needed, for their well-known purposes. Additional components which can be added to the polyurethane composition include UV stabilizers and other dyes, as well as optical brighteners and fluorescent pigments and dyes. Such additional ingredients may be added in any amounts that will achieve their desired purpose.

In a preferred embodiment of the present invention, the golf ball comprises a core encased in a multi-layer cover comprising an inner cover layer, an intermediate cover layer, and an outer cover layer, wherein at least one of the cover layers is a thin, dense layer. A preferred way to redistribute the weight of the golf ball is by adding fillers to at least one of the cover layers to achieve a desirable moment of inertia.

Suitable high density fillers may have specific gravity in the range from about 2 to about 19, and include, but are not limited to, metal (or metal alloy) powder, metal oxide, metal searates, particulates, carbonaceous materials, and the like or blends thereof. Examples of useful metal (or metal alloy) powders include, but are not limited to, bismuth powder, boron powder, brass powder, bronze powder, cobalt powder, copper powder, inconel metal powder, iron metal powder, molybdenum powder, nickel powder, stainless steel powder, titanium metal powder, zirconium oxide powder, aluminum flakes, tungsten metal powder, beryllium metal powder, zinc metal powder, or tin metal powder. Examples of metal oxides include but are not limited to zinc oxide, iron oxide, aluminum oxide, titanium dioxide, magnesium oxide, zirconium oxide, and tungsten trioxide. Examples of particulate carbonaceous materials include but are not limited to graphite and carbon black. Examples of other useful fillers include but are not limited to graphite fibers, precipitated hydrated silica, clay, talc, glass fibers, aramid fibers, mica, calcium metasilicate, barium sulfate, zinc sulfide, silicates, diatomaceous earth, calcium carbonate, magnesium carbonate, regrind (which is recycled uncured center material mixed and ground to 30 mesh particle size), manganese powder, and magnesium powder. A more preferred high density filler is tungsten, tungsten oxide or tungsten metal powder due to its particularly high specific gravity of about 19.

Due to the very thin nature of the cover layers of the present invention, it has been determined that the use of a castable, reactive material, which is applied in a fluid form, makes it possible to obtain very thin outer cover layers on golf balls. Specifically, it has been determined that castable, reactive liquids, which react to form a urethane elastomer material, provide desirable very thin outer cover layers.

The castable, reactive liquid employed to form the urethane elastomer material can be applied over the core using a variety of application techniques such as spraying, dipping, spin coating, or flow coating methods which are well known in the art. An example of a suitable coating technique is that which is disclosed in U.S. Pat. No. 5,733,428, the disclosure of which is hereby incorporated by reference in its entirety.

The outer cover is preferably formed around the core and intermediate cover layers by mixing and introducing the material in the mold halves. It is important that the viscosity be measured over time, so that the subsequent steps of filling each mold half, introducing the core into one half and closing the mold can be properly timed for accomplishing centering of the core cover halves fusion and achieving overall uniformity. Suitable viscosity range of the curing urethane mix for introducing cores into the mold halves is determined to be approximately between about 2,000 cP and about 30,000 cP, with the preferred range of about 8,000 cP to about 15,000 cP.

To start the outer cover formation, mixing of the prepolymer and curative is accomplished in a motorized mixer including mixing head by feeding through lines metered amounts of curative and prepolymer. Top preheated mold halves are filled and placed in fixture units using pins moving into holes in each mold. After the reacting materials have resided in top mold halves for about 40 to about 80 seconds, a core is lowered at a controlled speed into the gelling reacting mixture. At a later time, a bottom mold half or a series of bottom mold halves have similar mixture amounts introduced into the cavity.

A ball cup holds the ball core through reduced pressure (or partial vacuum). Upon location of the coated core in the halves of the mold after gelling for about 40 to about 80 seconds, the vacuum is released allowing core to be released. The mold halves, with core and solidified cover half thereon, are removed from the centering fixture unit, inverted and mated with other mold halves which, at an appropriate time earlier, have had a selected quantity of reacting polyurethane prepolymer and curing agent introduced therein to commence gelling.

Similarly, U.S. Pat. Nos. 5,006,297 and 5,334,673 disclose suitable molding techniques which may be utilized to apply the castable reactive liquids employed in the present invention. Further, U.S. Pat. Nos. 6,180,040 and 6,180,722 disclose methods of preparing dual core golf balls. The disclosures of these patents are hereby incorporated by reference in their entirety.

While either of the inner cover layer and the intermediate cover layer may comprise a polyurethane, as disclosed above, it is preferred that only one of the two layers comprise polyurethane. For example, if the inner cover layer comprises a thermoset polyurethane, the intermediate layer cannot comprise polyurethane, and vice versa. The outer cover layer, of course, preferably comprises polyurethane.

Depending on the desired properties, balls prepared according to the invention can exhibit substantially the same or higher resilience, or coefficient of restitution ("COR"), with a decrease in compression or modulus, compared to balls of conventional construction. Additionally, balls prepared according to the invention can also exhibit substantially higher resilience, or COR, without an increase in compression, compared to balls of conventional construction.

The resultant golf balls typically have a coefficient of restitution of greater than about 0.7, preferably greater than about 0.75, and more preferably greater than about 0.78. The golf balls also typically have an ATTI compression of at least about 40, preferably from about 50 to 120, and more preferably from about 60 to 100. As used herein, the term "ATTI compression" is defined as the deflection of an object or material relative to the deflection of a calibrated spring, as measured with an ATTI Compression Gauge, that is commercially available from Atti Engineering Corp. of Union City, N.J. ATTI compression is typically used to measure the compression of a golf ball. When the ATTI Gauge is used to measure cores having a diameter of less than 1.680 inches, it should be understood that a metallic or other suitable shim is used to make the diameter of the measured object 1.680 inches.

When golf balls are prepared according to the invention, they typically will have dimple coverage greater than about 60 percent, preferably greater than about 65 percent, and more preferably greater than about 75 percent. The flexural modulus of the cover on the golf balls, as measured by ASTM method D6272-98, Procedure B, is typically greater than about 500 psi, and is preferably from about 500 psi to 150,000 psi.

The outer cover can have any material hardness sufficient to provide predetermined ball performance characteristics. In a low spin embodiment, the material of the outer cover layer should have a material hardness greater than about 55 Shore D, preferably greater than about 60 Shore D, more preferably between about 60 and about 80 Shore D, and most preferably between about 70 and about 80 Shore D. In a high spin embodiment, the material of the outer cover layer should have a material hardness less than about 65 Shore D, preferably less than about 50 Shore D, more preferably between about 10 and about 40 Shore D, and most preferably between about 30 and about 40 Shore D.

More importantly, however, is the relationship between the inner cover layer, the intermediate cover layer, and the outer cover layer. The inner and intermediate cover layers can have any material hardness sufficient to produce a predetermined set of golf ball playing characteristics. The outer cover layer has a first material hardness, the intermediate cover layer has a second material hardness, and the inner cover layer has a third material hardness. There are a number of different embodiments that will produce a low- or high-spin golf ball when that particular outer cover layer has been selected.

In a first embodiment, the third hardness is greater than the first hardness, which is greater than the second hardness i.e., the inner cover layer is the hardest layer, the intermediate layer is the softest, and the outer cover layer is the between the two. The inner cover layer hardness is preferably greater than about 60 Shore D and more preferably, greater than about 70 Shore D; the intermediate layer is preferably less than about 55 Shore D; and the outer cover layer is preferably greater than about 55 Shore D.

In a second embodiment, the second hardness is greater than the first hardness, which is greater than the third hardness, i.e., the intermediate cover layer is the hardest layer, the inner cover layer is the softest layer, and the outer cover layer is between the two. The intermediate cover layer hardness is preferably greater than about 60 Shore D, the inner cover layer hardness is preferably less than about 55 Shore D, and the outer cover layer is preferably between about 50 and about 65 Shore D.

In a third embodiment, the first and second hardness are identical and greater than the third hardness, i.e., the inner cover is softer than either the intermediate or cover layers. Preferably, the outer and intermediate cover layers have an identical hardness greater than about 60 Shore D and the inner cover layer hardness is less than about 55 Shore D.

In a fourth embodiment, the first and second hardness are identical and less than the third hardness, i.e., the inner cover layer is the hardest layer and the outer cover and intermediate cover layers are softer and identical in hardness. Preferably, the inner cover layer has a hardness greater than about 55 Shore D and the intermediate and outer cover layers have identical hardness less than about 60 Shore D.

In a fifth embodiment, the second and third hardness are identical and greater than the first hardness, i.e., the intermediate and inner cover layers are identical and harder than the outer cover layer. Preferably, the outer cover layer has a material hardness of less than about 55 Shore D and the intermediate and inner cover layers have identical hardness values greater than about 60 Shore D.

In a sixth embodiment, the second and third hardness are identical and less than the first, i.e., the intermediate and inner cover layers are identical and softer than the outer cover layer. Preferably, the intermediate and inner cover layers have an identical hardness less than about 55 Shore D and the outer cover layer has a hardness greater than about 55 Shore D.

It should be understood, especially to one of ordinary skill in the art, that there is a fundamental difference between "material hardness" and "hardness, as measured directly on a golf ball." Material hardness is defined by the procedure set forth in ASTM-D2240 and generally involves measuring the hardness of a flat "slab" or "button" formed of the material of which the hardness is to be measured. Hardness, when measured directly on a golf ball (or other spherical surface) is a completely different measurement and, therefore, results in a different hardness value. This difference results from a number of factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other. As used herein, the term "hardness" refers to material hardness, as defined above.

The core of the present invention has an ATTI compression of between about 50 and about 90, more preferably, between about 60 and about 85, and most preferably, between about 70 and about 85.

The overall outer diameter ("OD") of the core is less than about 1.590 inches, more preferably between about 1.540 inches and about 1.570 inches, and most preferably between about 1.525 inches to about 1.560 inches. The OD of the inner cover layer of the golf balls of the present invention is preferably between about 1.580 inches and about 1.640 inches, more preferably between about 1.600 inches to about 1.630 inches, and most preferably between about 1.610 inches to about 1.30 inches.

The present multi-layer golf ball can have an overall diameter of any size. Although the United States Golf Association ("USGA") specifications limit the minimum size of a competition golf ball to 1.680 inches. There is no specification as to the maximum diameter. Golf balls of any size, however, can be used for recreational play. The preferred diameter of the present golf balls is from about 1.680 inches to about 1.800 inches. The more preferred diameter is from about 1.680 inches to about 1.760 inches. The most preferred diameter is about 1.680 inches to about 1.740 inches.

In another aspect of the invention, multi-layer covers of the present invention comprise at least one thin dense layer. Preferably, thin dense layer is located proximate to outer cover, and preferably the dense layer is made as thin as possible. The dense layer may have a thickness from about 0.001 inches to about 0.05 inches (0.025 mm to 1.27), more preferably from about 0.005 inches to about 0.030 inches (0.127 mm to 0.76 mm), and most preferably from about 0.010 inches to about 0.020 inches (0.25 mm to 0.5 mm). The dense layer preferably has a specific gravity of greater than 1.2, more preferably more than 1.5, even more preferably more than 1.8 and most preferably more than 2.0. Preferably, the dense layer is located as close as possible to the outer surface of ball, i.e, the land surface or the un-dimpled surface of cover. For golf ball having a cover thickness of about 0.030 inches (0.76 mm), the thin dense layer would be located from 0.031 inches to about 0.070 inches (0.79 mm to 1.78 mm) from the land surface including the thickness of the thin dense layer. For a golf ball having a cover thickness (one or more layers of the same or different material) of about 0.110 inches (2.8 mm), the thin dense layer would be located from about 0.111 inches to about 0.151 inches (2.82 mm to 3.84 mm) from the land surface.

Suitable materials for the thin dense layer include any material that meets the specific gravity and thickness conditions stated above. The thin dense layer is preferably applied to the inner core as a liquid solution, dispersion, lacquer, paste, gel, melt, etc. such as a loaded or filled natural or non-natural rubber latex, polyurethane, polyurea, epoxy, polyester, any reactive or non-reactive coating or casting material, and then cured, dried or evaporated down to the equilibrium solids level. The thin dense layer may also be formed by compression or injection molding, RIM, casting, spraying, dipping, powder coating, or any means of depositing materials onto the inner core. The thin dense layer may also be a thermoplastic polymer loaded with a specific gravity increasing filler, fiber, flake or particulate, such that it can be applied as a thin coating and meets the preferred specific gravity levels discussed above. One particular example of a thin dense layer, which was made from a soft polybutadiene with tungsten powder using the compression molded method, has a thickness of about 0.021 inches to about 0.025 inches (0.53 mm to 0.64 mm) and a specific gravity of 1.31 and a Shore C hardness of about 72.

For reactive liquid systems, the suitable materials include any material which reacts to form a solid such as epoxies, styrenated polyesters, polyurethanes or polyureas, liquid PBR's, silicones, silicate gels, agar gels, etc. Casting, RIM, dipping and spraying are the preferred methods of applying a reactive thin dense layer. Non-reactive materials include any combination of a polymer either in melt or flowable form, powder, dissolved or dispersed in a volatile solvent. Suitable thermoplastics are disclosed in U.S. Pat. Nos. 6,149,535 and 6,152,834.

Alternatively, a loaded thin film or "pre-preg" or a "densified loaded film," as described in U.S. Pat. No. 6,010,411 related to golf clubs, may be used as the thin film layer in a compression molded or otherwise in a laminated form applied inside the cover layer. The "pre-preg" disclosed in the '411 patent may be used with or without the fiber reinforcement, so long as the preferred specific gravity and preferred thickness levels are satisfied. The loaded film comprises a staged resin film that has a densifier or weighing agent, preferably copper, iron or tungsten powder evenly distributed therein. The resin may be partially cured such that the loaded film forms a malleable sheet that may be cut to desired size and then applied to the outside of the core or inside of the cover. Such films are available from the Cytec of Anaheim, Calif. or Bryte of San Jose, Calif.

The inner core of ball may be constructed from many materials, so long as its specific gravity counter-balances the high specific gravity of the thin dense layer, such that ball is within the USGA legal weight. Inner core is preferably a solid unitary or solid multi-piece core, and may include a wound layer, a liquid, a gel, and a hollow or foamed layer. The core may also include one or more layers of polybutadiene encased in a layer or layers of polyurethane. If a liquid form of the thin dense layer is deposited next to a wound layer, the liquid material may penetrate into the wound layer. U.S. Pat. No. 5,947,843 predicted that a prevulcanized latex material could penetrate to a depth of 0.050 inches. However, the depth of penetration depends on factors such as the viscosity and temperature of the liquid and the spacing or other surface phenomenon of the wound layer. When the inner core is a solid or non-wound core, the thin dense layer in liquid form may leave a film having a thickness of 0.001 inch or higher. The liquid material may be cured with ultraviolet waves or dried with heat or at ambient conditions. When the liquid is dried with heat, the inner core material is preferably made from a thermosetting material to avoid heat softening of the core. A preferred latex is a pre-vulcanized Heveatex model No. 1704, manufactured by Heveatex Corporation, Fall River, Mass. Also, other latex coated cores are disclosed in U.S. Pat. Nos. 5,989,136 and 6,030,296. U.S. Pat. Nos. 5,993,968 discloses a wound core impregnated with a urethane dispersion (non-filled) prior to a thermoplastic material being injection molded over the core.

The term "about," as used herein in connection with one or more numbers or numerical ranges, should be understood to refer to all such numbers, including all numbers in a range.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A golf ball comprising a non-wound core and a cover, wherein the cover comprises:

an inner cover layer being disposed directly adjacent the core;

an outer cover layer having a thickness less than about 0.050 inches; and an intermediate cover layer is disposed between the inner and outer cover layers;

wherein at least one of the inner, intermediate, or outer cover layers is a dense layer having an inner diameter of at least 38.4 mm (1.51 inches), a specific gravity greater than about 1.2 and a thickness between about 0.025 mm (0.0001 inches) and about 1.27 mm (0.05 inches); and wherein the core has a specific gravity of less than the specific gravity of the dense layer, a diameter between about 35 mm and about 42 mm, and a compression of less than about 90.

2. The golf ball of claim 1, wherein the outer cover layer comprises a composition formed of a reactive liquid material.

3. The golf ball of claim 1, wherein the dense layer has a specific gravity of at least about 1.5.

4. The golf ball of claim 3, wherein the dense layer has a specific gravity of at least about 1.8.

5. The golf ball of claim 4, wherein the dense layer has a specific gravity of at least about 2.0.

6. The golf ball of claim 1, wherein the dense layer comprises polyurethanes, polyureas, polyurethane ionomers, epoxies, polyesters, silicones, rubber latex, or a mixture thereof.

7. The golf ball of claim 1, wherein the dense layer comprises a thermoplastic polymer.

8. The golf ball of claim 1, wherein the dense layer has a hardness of at least about 30 Shore D.

9. The golf ball of claim 8, wherein the dense layer has a hardness of at least about 50 Shore D.

10. The golf ball of claim 9, wherein the dense layer has a hardness of at least about 60 Shore D.

11. The golf ball of claim 7, wherein the thermoplastic material comprises polyolefins, polyethylene, polypropylene, polybutylene, polyethylene acrylic acid copolymers, polyethylene methacrylic acid copolymers, polyethylene methacrylic acid terpolymers, polyethylene acrylic acid terpolymers, polyethylene ethyl acrylate, polyethylene methyl acrylate, polyethylene vinyl acetate, polyethylene glycidyl alkyl acrylate, ionomers fully or partially neutralized by a metal ion or a salt of an organic acid, metallocenes, polyesters, polyamides, thermoplastic elastomers, copolyether esters, copolyether-amides, thermoplastic polyurethanes, or a mixture thereof.

12. The golf ball of claim 1, wherein the thin dense layer is positioned at a distance ranging from 0.76 mm to 2.8 mm from to land surface of the ball.

13. The golf ball of claim 1, wherein the thickness of the thin dense layer is from 0.127 mm to 0.76 mm.

14. The golf ball of claim 13, wherein the thickness of the dense layer is between about 0.25 mm and about 0.5 mm.

15. The golf ball of claim 1, wherein the dense layer is made from a densified loaded film.

16. The golf ball of claim 1, wherein the dense layer is made from a thermoplastic polymer loaded with a specific gravity increasing agent.

17. The golf ball of claim 16, wherein the specific gravity increasing agent comprises tungsten powder.

18. The golf ball of claim 1, wherein the dense layer is applied to the core as a liquid solution.

19. The golf ball of claim 1, wherein the dense layer is formed by compression or injection molding, reaction injection molding, casting, spraying, dipping or powder coating.

20. The golf ball of claim 1, wherein the inner cover is the dense layer and the intermediate and outer cover layers each have a specific gravity less than the dense layer.

21. The golf ball of claim 1, wherein the intermediate layer is the dense layer and the inner and outer cover layers each have a specific gravity less than the dense layer.

22. The golf ball of claim 1, wherein the dense layer is a non-continuous layer and the core has a specific gravity of less than about 1.1.

23. The golf ball of claim 22, wherein the non-continuous layer has a specific gravity greater than about 1.8.

24. The golf ball of claim 23, wherein the non-continuous layer has a specific gravity greater than about 2.0.

25. The golf ball of claim 22, further comprising a second dense layer directly abutting the non-continuous layer.

* * * * *